US006673443B2

(12) United States Patent
Koyanagi et al.

(10) Patent No.: US 6,673,443 B2
(45) Date of Patent: Jan. 6, 2004

(54) POLYESTER CONJUGATE FIBER PIRN AND METHOD FOR PRODUCING SAME

(75) Inventors: Tadashi Koyanagi, Nobeoka (JP); Takao Abe, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/206,960

(22) Filed: Jul. 30, 2002

(65) Prior Publication Data

US 2003/0108740 A1 Jun. 12, 2003

(30) Foreign Application Priority Data

Sep. 18, 2001 (JP) ..... 2001-283311

(51) Int. Cl.[7] ..... D01F 6/00; B65D 85/66
(52) U.S. Cl. ..... 428/364; 428/395; 206/392
(58) Field of Search ..... 206/392; 428/364, 428/395

(56) References Cited

U.S. PATENT DOCUMENTS

| | | | | |
|---|---|---|---|---|
| 3,671,379 A | | 6/1972 | Evans et al. | 161/173 |
| 4,986,483 A | * | 1/1991 | Ryu et al. | 242/45 |
| 6,306,499 B1 | | 10/2001 | Ochi et al. | 428/364 |

FOREIGN PATENT DOCUMENTS

| | | |
|---|---|---|
| EP | 1 059 372 A2 | 12/2000 |
| GB | 965729 | 8/1961 |
| JP | 43-19108 | 8/1948 |
| JP | 61211277 A | 9/1986 |
| JP | 11189923 A | 7/1999 |
| JP | 2000136440 A | 5/2000 |
| JP | 2000239927 A | 9/2000 |
| JP | 2000256918 A | 9/2000 |
| JP | 2001-55634 | 2/2001 |
| JP | 2001040537 A | 2/2001 |
| JP | 2001-131837 | 5/2001 |
| JP | 2002054029 A | 2/2002 |
| JP | 2002061031 A | 2/2002 |
| JP | 2002088586 A | 3/2002 |
| JP | 2002180332 A | 6/2002 |
| WO | WO 00/22210 | 4/2000 |
| WO | WO 00/47507 | 8/2000 |
| WO | WO 00/58537 | 10/2000 |
| WO | WO 01/53573 A1 | 7/2001 |
| WO | WO 02/063080 A1 | 8/2002 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention provides a polyester-based conjugate fiber pirn that is formed by winding, in a pirn shape, a conjugate fiber wherein the fiber is formed from a single filament prepared by combining two types of polyester components in a side-by-side manner or in an eccentric sheath-core manner, and at least one polyester component forming the single filament is a poly(trimethylene terephthalate) containing 90% by mole or more of trimethylene terephthalate repeating units, the winding amount of the conjugate fiber pirn being 1 kg or more, the winding angle in a taper portion thereof being from 15 to 21°, the winding hardness in the cylinder portion thereof being from 75 to 92, and the starting temperature of thermal shrinkage stress manifestation of the conjugate fiber being from 50 to 80° C.

14 Claims, 4 Drawing Sheets

POLYESTER CONJUGATE FIBER PIRN AND METHOD FOR PRODUCING SAME

TECHNICAL FIELDS

The present invention relates to a pirn of a conjugate fiber formed from two types of polyesters, and method for producing the same.

BACKGROUND ART

Poly(ethylene terephthalate) (hereinafter abbreviated to PET) fibers are mass-produced around the world as synthetic fibers most suitable for clothing applications, and the production thereof has become a large industries.

Poly(trimethylene terephthalate) (hereinafter abbreviated to PTT) fibers are known from the prior art technologies such as those disclosed in the following references: J. polymer Science: polymer Physics Edition, Vol. 14 (1976) p 263–274; Chemical Fibers International, Vol. 45, April (1995) p 110–111; Japanese Unexamined Patent Publication (Kokai) No. 52-5320; Japanese Unexamined Patent Publication (Kokai) No. 52-8123; Japanese Unexamined Patent Publication (Kokai) No. 52-8124; WO 99/2716; and WO 00/22210.

The references to the prior art technologies describe that when PTT fibers show appropriate breaking elongation, thermal stress and boil-off shrinkage, knitted or woven fabrics, in which the PTT fibers are used, can manifest a low elastic modulus and a soft feel. The references also describe that such PTT fibers are appropriate to clothing such as underwear, outerwear, sportswear, leg wear, lining cloth and swimwear.

On the other hand, a side-by-side type or eccentric sheath-core type conjugate fiber is known as a fiber to which bulkiness can be imparted without false twisting.

A conjugate fiber, for at least one component of which a PTT is used or for both components of which two respective PTTs differing from each other in intrinsic viscosity are used (hereinafter referred to as polyester-based conjugate fiber), is known as a conjugate fiber having a soft feel specific to PTT. For example, such conjugate fibers are described in the following references: Japanese Examined Patent Publication (Kokoku) No. 43-19108; Japanese Unexamined Patent Publication (Kokai) No. 11-189923; Japanese Unexamined Patent Publication (Kokai) No. 2000-239927; Japanese Unexamined Patent Publication (Kokai) No. 2000-256918; Japanese Unexamined Patent Publication (Kokai) No. 2001-55634; EP 1059372; Japanese Unexamined Patent Publication (Kokai) No. 2001-40537; Japanese Unexamined Patent Publication (Kokai) No. 2001-131837; Japanese Unexamined Patent Publication (Kokai) No. 2002-61031; Japanese Unexamined Patent Publication (Kokai) No. 2002-54029; Japanese Unexamined Patent Publication (Kokai) No. 2002-88586; U.S. Pat. No. 6,306,499 and WO 01/53573. These references describe that a polyester-based conjugate fiber characteristically has a soft feel and a good development of crimp, and that the fiber can be applied to various stretch knitted or woven fabrics or bulky knitted or woven fabrics by utilizing these properties.

In the production of synthetic fibers such as polyamide and polyester fibers, drawn fibers have heretofore been obtained by a two-stage system comprising melt spinning a polymer, winding an undrawn fiber, and drawing the undrawn fiber. WO 00/22210 as mentioned above describes the technology. Although the winding shape of the drawn fiber thus wound by the two-stage system can be a cheese shape or a pirn shape, it is generally a pirn shape.

A fiber wound in a pirn shape is used for preparing a knitted or woven fabric without further processing.

Alternatively, the fiber is false twisted for the purpose of imparting bulkiness and stretchability to the fabric, and then used for preparing a knitted or woven fabric.

False twisting a fiber wound in a pirn shape is hindered by the unwindability of the fiber, from the pirn, or by yarn breakage during false twisting, and pin false twisting in which the false twisting rate is 100 m/min at the most has been adopted. The false twisting method disclosed in WO 00/22210 mentioned above also belongs to this category. However, in order to reduce the processing cost in recent years, even the pin false twisting must be conducted at a rate of 150 m/min or more, and adoption of high-speed false twisting at a rate of from 200 to 700 m/min in which a disc or belt is used has been required.

According to investigations by the present inventors, high-speed false twisting of a polyester-based conjugate fiber pirn differs from false twisting of a PET fiber in that it has the following problems: (a) yarn breakage takes place during unwinding; (b) yarn breakage takes place on a false twisting heater; and (c) uneven dyeing of a false-twisted yarn occurs. In particular, when industrial production is taken into consideration, it has become evident that the problems are manifested in a pirn holding a large amount of yarn.

(a) Yarn Breakage during Unwinding

Because a PTT fiber is excellent in elastic recovery, the drawing stress a yarn suffers during drawing remains as a shrinkage force when the yarn is wound into a drawn yarn pirn, and the drawn yarn pirn is tightly wound. The tight winding of a drawn yarn pirn becomes more significant when the period from directly after winding the yarn in a pirn shape to until the yarn is actually supplied to false twisting is longer and the winding amount is larger.

A drawn yarn pirn that is tightly wound has a high winding hardness. When a yarn is to be unwound from such a drawn yarn pirn, the unwinding tension greatly fluctuates in the longitudinal direction of the yarn, and an extraordinary high tension is produced, in some cases, to cause yarn breakage.

(b) Yarn Breakage on False Twisting Heater

A proper false twisting temperature range of a polyester-based conjugate fiber is extremely narrow in comparison with a PET fiber, and the fiber must be false twisted at heater temperature of from 150 to 180° C. When the heater temperature is lower than 150° C., the crimp of the false twisted yarn flows in a knitting or weaving stage or a dyeing stage, or the like disadvantageous phenomenon takes place. The crimpability of the false-twisted yarn is deteriorated, and a practically usable processed yarn is hardly obtained. On the other hand, when the heater temperature exceeds 180° C., yarn breakage tends to take place on the heater. That is, because the thermal shrinkage characteristics of the drawn yarn provided to false twisting greatly influence the false twisting ability, strict selection of the thermal shrinkage characteristics is particularly important to the polyester-based conjugate fiber.

(c) Uneven Dyeing of False-Twisted Yarn

The false-twisted yarn obtained by false twisting a polyester-based conjugate fiber tends to produce uneven dyeing in comparison with the false-twisted yarn obtained by false twisting a fiber of PTT alone. The reason is thought to be as follows though it is not clear. The fluctuation of the unwinding tension described in (a) or manifestation of the crimp a polyester-based conjugate fiber makes the contact resistance of the yarn to guides of the false twisting machine significant. As a result, the fluctuation of a tension during false twisting becomes significant to produce nonuniformity in a yarn that influences the dyeing quality of false twisting.

The problems as mentioned above of false twisting a polyester-based conjugated fiber have not been anticipated from a knowledge concerning a PET fiber. The problems have been elucidated for the first time from the research by the present inventors. The above references of the prior art technologies neither disclose nor suggest practical problems on an industrial production scale in such false twisting. It is needless to say that methods of solving the problems have never been known.

DISCLOSURE OF THE INVENTION

An object of the present invention is to provide a polyester-based conjugate fiber pirn excellent in high-speed false twisting ability though the pirn is obtained by a two-stage method. More specifically, an object of the present invention is to provide a polyester-based conjugate fiber pirn that shows good unwindability even in high-speed false twisting, that produces neither yarn breakage nor fluff formation during false twisting even at a high heater temperature and that, consequently, can provide a false-twisted yarn having good dyeing quality, and a method for producing the same.

That is, the problems of the present invention is to overcome are: poor unwindability of a polyester-based conjugate fiber from a pirn; yarn breakage during false twisting at a high rate while good crimp characteristics are being held; and fluff formation and uneven dyeing of a false-twisted yarn.

As a result of intensively carrying out investigations to solve the problems mentioned above, the present inventors have made the following discoveries. A polyester-based conjugate fiber pirn obtained by winding a polyester-based conjugate fiber in a pirn shape under specific winding conditions and aging the wound pirn under specific conditions shows specific thermal shrinkage, a specific winding shape of a pirn and a specific winding hardness. As a result, a polyester-based conjugate fiber pirn showing excellent high-speed false twisting ability without yarn breakage during unwinding and false twisting can be obtained, and a processed yarn of excellent quality can be obtained by false twisting.

That is, the present invention is as explained below.

1. A polyester-based conjugate fiber pirn characterized in that the polyester-based conjugate fiber pirn is formed by winding, in a pirn shape that satisfies the conditions (1) to (4) mentioned below, a conjugate fiber wherein the fiber is formed from a single filament prepared by combining two types of polyester components in a side-by-side manner or in an eccentric sheath-core manner, and at least one polyester component forming the single filament is a poly (trimethylene terephthalate) containing 90% by mole or more of trimethylene terephthalate repeating units.

(1) The winding amount of the conjugate fiber pirn is 1 kg or more.

(2) The winding angle in a taper portion thereof is from 15 to 21°.

(3) The winding hardness in the cylinder portion thereof is from 75 to 92.

(4) The starting temperature of thermal shrinkage stress manifestation of the conjugate fiber is from 50 to 80° C.

2. A polyester-based conjugate fiber pirn characterized in that the polyester-based conjugate fiber pirn is formed by winding, in a pirn shape that satisfies the conditions (1) to (6) mentioned below, a conjugate fiber wherein the fiber is formed from a single filament prepared by combining two types of polyester components in a side-by-side manner or an eccentric sheath-core manner, and at least one polyester component forming the single filament is a poly (trimethylene terephthalate) containing 90% by mole or more of trimethylene terephthalate repeating units.

(1) The winding amount of the conjugate fiber pirn is 1 kg or more.

(2) The winding angle in a taper portion thereof is from 15 to 21°.

(3) The winding hardness in the cylinder portion thereof is from 80 to 90.

(4) The level difference between surface recesses and surface protrusions in the cylinder portion thereof is 250 $\mu$m or less.

(5) The dynamic friction coefficient between fibers of the conjugate fiber is from 0.20 to 0.35.

(6) The starting temperature of thermal shrinkage stress manifestation of the conjugate fiber is from 50 to 75° C.

3. The polyester-based conjugate fiber pirn according to 2 above, wherein the difference between the maximum and minimum values of a dynamic friction coefficient between fibers of the conjugate fiber in the longitudinal direction of the yarn is 0.05 or less.

4. The polyester-based conjugate fiber pirn according to any one of 1 to 3 above, wherein the winding density of the pirn is from 0.90 to 1.10 g/cm$^3$.

5. The polyester-based conjugate fiber pirn according to any one of 1 to 4 above, wherein the difference between the maximum and minimum values of a stress at 10% elongation is 0.30 cN/dtex or less in elongation-stress measurements of the conjugate fiber.

6. The polyester-based conjugate fiber pirn according to any one of 1 to 5 above, wherein the breaking elongation of the conjugate fiber is from 30 to 50%.

7. The polyester-based conjugate fiber pirn according to any one of 1 to 6 above, wherein the difference between the maximum and minimum values of a crimp ratio ($CE_{3.5}$) of the conjugate fiber measured while a load of $3.5\times10^{-3}$ cN/dtex is being applied to the fiber is 10% or less.

8. The polyester-based conjugate fiber pirn according to any one of 1 to 7 above, wherein the shape-modification degree of the conjugate fiber is from 1 to 5.

9.The polyester-based conjugate fiber pirn according to any one of 1 to 8 above, wherein both of the two types of components of a single filament forming the conjugate fiber are poly(trimethylene terephthalate) containing 90% by mole or more of trimethylene terephthalate repeating units, and the thermal shrinkage stress of the conjugate fiber is from 0.1 to 0.24 cN/dtex.

10. A false-twisted yarn obtained by false twisting the polyester-based conjugate fiber wound in the shape of the polyester-based conjugate fiber pirn according to any one of 1 to 9 mentioned above.

11. A method for producing a polyester-based conjugate fiber pirn, wherein two types of polyesters in which at least one type of polyester contains 90% by mole or more of trimethylene terephthalate repeating units are injected from a spinneret by melt spinning, the injected polyesters are cooled and solidified with cooling air, the solidified yarn is drawn, and a conjugate fiber formed from a single filament that is formed by combining the two types of polyesters in a side-by-side manner or in an eccentric sheath-core manner is wound in a pirn shape in an amount of 1 kg or more, the method satisfying the conditions (A) to (C) mentioned below.

(A) The tension of the yarn during drawing is from 0.10 to 0.35 cN/dtex.

(B) The relaxation ratio during winding the conjugate fiber in a pirn shape is from 2 to 5%.

(C) The conjugate fiber pirn is aged in an atmosphere at a temperature of from 25 to 45° C. for 10 days or more.

12. The method for producing a polyester-based conjugate fiber pirn according to 11 above, wherein the conjugate fiber pirn is aged in an atmosphere at a temperature of from 30 to 40° C.

13. A method for producing a polyester-based conjugate fiber pirn, wherein two types of polyesters, in which at least one type of polyester contains 90% by mole or more of trimethylene terephthalate repeating units, are injected from a spinneret by melt spinning, the injected polyesters are cooled and solidified with cooling air, the solidified yarn is drawn, and a conjugate fiber, formed from a single filament that is formed by combining the two types of polyesters in a side-by-side manner or in an eccentric sheath-core manner, is wound in a pirn shape in an amount of 1 kg or more, the method satisfying the conditions (a) to (e) mentioned below.

(a) The two types of polyesters are joined together in a spinneret, and injected through an injection nozzle that has a ratio of a nozzle length to a nozzle diameter of 2 or more and that has an inclination making an angle of from 10 to 40° with the vertical direction.

(b) The two types of polyesters are melt spun to form an undrawn yarn while the product of an average intrinsic viscosity [η] (dl/g) and an injection linear velocity V (m/min) thereof is being held at 4 to 15 (dl/g)·(m/min).

(c) The drawing tension is held at 0.10 to 0.35 cN/dtex.

(d) The conjugate fiber is wound in a pirn shape while the relaxation ratio is being held at 2 to 5%, whereby a conjugate fiber pirn is obtained.

(e) The conjugate fiber pirn is aged in an atmosphere at temperature of from 25 to 45° C. for 10 days or more.

14. The method for producing a polyester-based conjugate fiber pirn according to any one of 11 to 13 mentioned above, wherein the yarn is interlaced and/or twisted at any stage between the following stages: a stage of applying a finishing agent containing from 10 to 80% by weight of aliphatic ester and/or mineral oil or a finishing agent containing from 50 to 98% by weight of a polyether having a molecular weight of from 1,000 to 20,000 in an amount of from 0.3 to 1.5% by weight after cooling and solidifying the injected polyester to form a fiber; and a stage of winding the fiber in a pirn shape.

The present invention will be explained below in detail.

The polyester-based conjugate fiber in the present invention comprises a single filament that is prepared by combining two types of polyester components in a side-by-side manner or in an eccentric sheath-core manner, and at least one type of a polyester component forming the single filament is a PTT.

The conjugate fiber is a fiber in which the two types of polyester components are combined in a side-by-side manner along the filament direction. Alternatively, the conjugate fiber is a fiber in which one polyester component encloses all or part of the other polyester component, and both polyester components are arranged in the cross section of the filament in an eccentric sheath-core manner. The former side-by-side type conjugate fiber is preferred.

When a PTT is used as one of the two types of polyester components, crimp is well manifested after false twisting. Although there is no specific limitation on the other component, it is preferably selected from PET, PTT, poly (butylene terephthalate) (PBT), etc. in view of the bondability with PTT during combining.

The most preferred combination of the two types of polyester components is a combination of two PTTS. In the combination of PTTS, the average intrinsic viscosity is preferably from 0.7 to 1.2 dl/g, more preferably from 0.8 to 1.1 dl/g. When the average intrinsic viscosity is in the above range, the strength of the false-twisted yarn becomes about 2 cN/dtex or more, and the yarn can be applied to the field of sportswear that requires strength.

The intrinsic viscosity difference between the two types of PTTs is preferably from 0.05 to 0.8 dl/g, more preferably from 0.1 to 0.4 dl/g, and still more preferably from 0.1 to 0.25 dl/g. When the intrinsic viscosity difference is in the above range, crimp is sufficiently developed. Moreover, filament bending immediately below the spinning nozzle is insignificant and yarn breakage does not take place in the spinning stage.

In the present invention, the mixing ratio of the two types of polyesters, differing from each other in intrinsic viscosity, in the cross section of a single filament, is preferably from 40/60 to 70/30 in terms of a ratio of a low viscosity component to a high viscosity component, more preferably from 45/55 to 65/35. When the mixing ratio is in the above range, a conjugate fiber having excellent crimpability is obtained. Moreover, the yarn strength becomes 2.5 cN/dtex or more, and the conjugate fiber can be used for sports applications.

In the present invention, the PTT comprises 90% by mole or more of trimethylene terephthalate repeating units and 10% by mole or more or less of other ester repeating units. That is, the PTT includes a PTT homopolymer and a PTT copoylmer containing 10% by mole or less of other ester repeating units.

The copolymer components include, for example, the following substances.

Examples of the acid components include aromatic dicarboxylic acids such as isophthalic acid and 5-sodium sulfoisophthalic acid, and aliphatic dicarboxylic acids such as adipic acid and itaconic acid. Examples of the glycol component include ethylene glycol, butylene glycol and polyethylene glycol. Moreover, hydroxycarboxylic acids such as hydroxybenzoic acid are also included. A plurality of these compounds may also be copolymerized. Three functional crosslinking components such as trimellitic acid, pentaerithrytol, and pyromellitic acid tend to impair spinning stability, and lower the breaking elongation of a false-twisted yarn so that yarn breakage often takes place during false twisting. It is therefore preferred, in some cases, to avoid copolymerization of the components.

There is no specific limitation on the method for producing PTT to be used in the present invention, and known methods can be applied. Examples of the production method include: a one-stage method comprising melt polymerizing alone so that the polymer has a polymerization degree corresponding to a predetermined intrinsic viscosity; and a two-stage method comprising melt copolymerizing so that the polymer has an increased polymerization degree corresponding to a given intrinsic viscosity, and solid phase polymerizing so that the polymer has an increased polymerization degree corresponding to a predetermined intrinsic viscosity.

Use of the latter two-stage method in which solid phase polymerization is employed in combination is preferred for the purpose of decreasing the content of a cyclic dimer.

When the one-stage method is employed to make the polymer have a polymerization degree corresponding to a predetermined intrinsic viscosity, cyclic dimers are preferably decreased prior to supplying the polymer to the spinning step by a treatment such as extraction.

A PTT used in the present invention preferably has a trimethylene terephthalate cyclic dimer content of from 0 to 2.5% by weight, more preferably from 0 to 1.1% by weight, and still more preferably from 0 to 1.0% by weight.

Furthermore, the polyester-based conjugate fiber in the present invention may be made to contain, as long as the effects of the present invention are not harmed, additives such as delustering agents (such as titanium oxide), thermal stabilizers, antioxidants, antistatic agents, ultraviolet ray absorbers, antibacterial agents and various pigments. The conjugate fiber may also be made to contain such additives by copolymerization.

The polyester-based conjugate fiber pirn of the present invention is formed by winding the fiber in a pirn shape. The winding amount of the conjugate fiber pirn is 1 kg or more, preferably 2 kg or more. When the winding amount is 1 kg or more, the frequency of the replacing operation for a pirn can be decreased in the subsequent treatment such as false twisting, and the efficiency is significant. Perticularly, when the winding amount of the pirn is 2 kg or more, the effect is extremety remarkable.

The polyester-based conjugate fiber pirn of the present invention is formed by winding the fiber at a winding angle in a taper portion of from 15 to 21°, preferably from 18 to 20°.

The polyester-based conjugate fiber pirn comprises taper portions and a cylinder portion. FIG. 1 shows one embodiment of the shape. A conventionally known PET fiber pirn is formed by winding a fiber at a winding angle in a taper portion of from 23 to 25°.

In contrast to the known pirn, the polyester-based conjugate fiber pirn of the present invention is characterised in that the pirn is formed by winding a fiber at an extremely low winding angle. Because the conjugate fiber pirn is formed by winding a fiber at a low winding angle in a taper portion as explained above, the unwindability of the pirn at a high rate becomes better. When the winding angle in a taper portion is less than 15°, the winding amount of the pirn becomes less than about 1 kg, and use of the pirn is economically disadvantageous. When the winding angle in a taper portion exceeds 21°, winding collapse tends to occur during winding to form a pirn or handling after winding, and the pirn shape is likely to be destabilized.

It is estimated that the good unwindability of a polyester-based conjugate fiber pirn is realized only when the winding angle is in such an extremely restricted range due to the properties of the conjugate fiber such as surface smoothness and elongation recovery.

The winding hardness in a cylinder portion of the polyester-based conjugate fiber pirn of the invention is from 75 to 92, preferably from 80 to 90, and more preferably from 82 to 88. When the winding hardness is 75 or more, the pirn shape never collapses during handling in transportation or the like.

A conventional polyester fiber pirn is wound to have a winding hardness of 93 or more. In contrast to the conventional pirn, the conjugate fiber pirn of the present invention is wound to have a low winding hardness as mentioned above. The advantages of such a low winding hardness are considered to be as follows. The drawing stress the conjugate fiber suffers during drawing is effectively relaxed, and tight winding during storage over a long period is avoided, to give a polyester-based conjugate fiber pirn having good unwindability.

The winding hardness is a value measured with a Vickers hardness meter. A smaller numerical value signifies that the winding hardness is lower.

The winding density of the polyester-based conjugate fiber pirn of the invention is preferably from 0.90 to 1.10 g/cm$^3$, more preferably from 0.92 to 1.05 g/cm$^3$. When the winding density is in the above range, the shape never collapses during handling in transportation or the like. Moreover, because the unwinding tension of the conjugate fiber from the pirn is low, yarn breakage never takes place even when the conjugate fiber is unwound at a high rate.

In the present invention, the starting temperature of thermal stress manifestation in the measurement of thermal shrinkage stress of the polyester-based conjugate fiber is from 50 to 80° C., preferably from 60 to 80° C. When the starting temperature of thermal stress manifestation is 50° C. or more, neither yarn breakage nor fluff formation occurs even at false twisting heater temperature of from 150 to 180° C., and stabilized false twisting can be conducted. When the starting temperature thereof is 80° C. or lower, the thermal shrinkage stress becomes 0.10 cN/dtex or more, and excellent false twisting ability can be obtained.

The thermal shrinkage stress of a polyester-based conjugate fiber is measured with a thermal stress measurement apparatus to be described later.

FIG. 2 shows one example of a thermal shrinkage stress curve. In FIG. 2, a curve (i) (solid line) is an example of a polyester-based conjugate fiber in the present invention, and a curve (ii) (broken line) is an instance of a conventional polyester-based conjugate fiber.

That is, when measurements are started from room temperature, a conventional polyester-based conjugate fiber begins to manifest a thermal shrinkage stress usually at temperature of from 40 to 45° C. as shown by the curve (ii) in FIG. 2. In contrast to the conventional conjugate fiber, the polyester-based conjugate fiber of the invention characteristically shows a starting temperature of thermal stress manifestation on the high temperature side as shown by the curve (i) in FIG. 2.

In the present invention, the extreme temperature of a thermal shrinkage stress of the conjugate fiber is preferably from 140 to 190° C., more preferably from 145 to 180° C. When the extreme temperature of a thermal shrinkage stress is in the above range, false twisting at heater temperature of 150° C. or more produces no slackening of the conjugate fiber on the heater, and the fiber can be stably false twisted. Moreover, crimp can be effectively imparted to the fiber by false twisting.

When the two types of polyester components are both PTTs in the present invention, the thermal shrinkage stress of the polyester-based conjugate fiber is preferably from 0.1 to 0.24 cN/dtex, more preferably from 0.15 to 0.24 cN/dtex. When the thermal shrinkage stress is in the above range, the tight winding of the conjugate fiber in the pirn is insignificant, and unwinding at a high rate can be smoothly conducted. Moreover, the winding hardness becomes 75 or more, and a stabilized pirn shape can be obtained.

The level difference between surface recesses and protrusions in the cylinder portion of a polyester-based conjugate fiber pirn in the present invention is preferably from 0 to 250 $\mu$m, more preferably from 50 to 200 $\mu$m, and still more preferably from 60 to 150 $\mu$m. A smaller level difference between surface recesses and protrusions is preferred. When the level difference between surface recesses and protrusions is 250 $\mu$m or less, the unwinding tension is uniform during unwinding at a high rate, and neither yarn breakage nor uneven dyeing occurs.

The level difference between surface recesses and protrusions in the cylinder portion is an index that indicates surface flatness of a polyester-based conjugate fiber pirn, and is measured by a method to be described later.

In the present invention, the dynamic friction coefficient between fibers of a polyester-based conjugate fiber wound in a pirn shape is preferably from 0.20 to 0.35, more preferably from 0.20 to 0.30. When the dynamic friction coefficient between fibers is in the above range, the conjugate fiber can be wound in a stabilized shape during winding in a pirn or cheese shape, and yarn collapse of the pirn never takes place. Moreover, the unwinding tension hardly fluctuates during unwinding at a high rate, and yarn breakage or the like hardly takes place. Furthermore, it is preferred that the dynamic friction coefficient between fibers hardly fluctuates in the longitudinal direction of the yarn.

In the present invention, the difference between the maximum and minimum values of a dynamic friction coefficient between fibers measured in the longitudinal direction of the yarn is 0.05 or less, more preferably 0.03 or less. When the difference therebetween is 0.05 or less, the unwinding tension is uniform during unwinding at a high rate, and yarn breakage never takes place.

In elongation-stress measurements of a conjugate fiber in the present invention, the difference between the maximum and minimum values of stress at 10% elongation is preferably 0.30 cN/dtex or less, more preferably 0.20 cN/dtex or less. When the difference between the stress values at 10% elongation in the longitudinal direction of the yarn is smaller, the conjugate fiber is dyed more uniformly. That the difference therebetween corresponds closely to the uniformity of dyeing of a conjugate fiber has been found by the present inventors. The stress values at 10% elongation are measured by a method to be described later.

The breaking elongation of a polyester-based conjugate fiber wound in a pirn shape in the present invention is preferably from 30 to 50%, more preferably from 35 to 45%. When the breaking elongation is in the above range, yarn breakage never takes place during false twisting even at heater temperatures as high as 150° C. or more, and a uniform polyester-based conjugate fiber without a fluctuation of fiber size is formed. A false-twisted yarn having no fluctuation of fiber size, even dyeing, and high quality is thus obtained. A yarn showing a larger breaking elongation can be false twisted at a higher heater temperature during false twisting.

That the breaking elongation greatly influences a suitable temperature of processing during false twisting has not been observed substantially in a PET fiber, and is a phenomenon specific to a polyester-based conjugate fiber. Accordingly, it has not been anticipated from a knowledge related to the false twisting ability of PET fibers that there is a proper value of breaking elongation when a polyester-based conjugate fiber is false twisted at suitable heater temperature.

The polyester-based conjugate fiber in the present invention developes significant crimp by heat treatment. In particular, the conjugate fiber is characterised in that it significantly develops crimp even when a load is applied thereto. For example, as described later, when the conjugate fiber is heat treated while a load of $3.5\times10^{-3}$ cN/dtex is being applied thereto, the conjugate fiber shows a crimp ratio of 10% or more, preferably 12% or more. Moreover, it is one characteristic of the conjugate fiber that the crimp ratio hardly fluctuates in the longitudinal direction of the yarn.

In the present invention, the difference between the maximum and minimum values of a crimp ratio ($CE_{3.5}$) of a polyester-based conjugate fiber in the longitudinal direction of the yarn, that is measured while a load of $3.5\times10^{-3}$ cN/dtex is being applied thereto, is preferably 10% or less. When the difference between the maximum and minimum values is 10% or less, the false-twisted yarn has an even crimp, and a processed yarn excellent in uniformity of dyeing is obtained. A smaller difference between the maximum and minimum values is preferred. A difference of 5% or less is preferred because the processed yarn is then uniformly dyed.

The shape-modification degree of the fiber cross section of a polyester-based conjugate fiber in the present invention is preferably from 1 to 5, more preferably from 1 to 4. When the shape-modification degree is 5 or less, a uniform tension of the conjugate fiber is obtained during unwinding the fiber even at a high rate from a pirn. The shape-modification degree of a fiber cross section is expressed by the ratio of a minor axis to a major axis of a fiber cross section observed when the fiber is cut vertically to the fiber axis. The shape-modification degree of a completely round cross section is 1.

Although there is no specific limitation on the size or single filament size of a polyester-based conjugate fiber in the present invention, the size of a conjugate fiber for knitted or woven fabric applications is preferably from 20 to 300 dtex, and the single filament size is preferably from 0.5 to 20 dtex.

Furthermore, in order to impart surface smoothness, cohesiveness and antistatic properties to a polyester-based conjugate fiber, a conventionally used finishing agent from 0.2 to 2% by weight may be applied thereto.

Still furthermore, in order to improve the unwindability and cohesiveness during false twisting, single filament interlacing may be imparted in an amount of preferably from 1 to 50/m, more preferably from 6 to 35/m.

Next, the method for producing a polyester-based conjugate fiber pirn will be explained.

A known composite fiber spinning apparatus with a double-screw extruder except for spinnerets and drawing conditions can be used for producing a polyester-based conjugate fiber pirn of the invention.

FIG. 3 shows one embodiment of a spinneret. In FIG. 3, (a) and (b) designate a distribution plate and a spinning nozzle, respectively. Two types of polyesters (A), (B) differing from each other in intrinsic viscosity are fed to the spinning nozzle (b) through the distribution plate (a), joined together at the spinning nozzle (b), and injected through an injection nozzle having an inclination making an angle of inclination of θ degrees with the vertical direction. The nozzle diameter and nozzle length of the spinning nozzle are designated by D and L, respectively.

The ratio of a nozzle length L to a nozzle diameter D (L/D) is preferably 2 or more.

In order to stabilize the bonding state of the two polyester components differing from each other in composition or intrinsic viscosity after joining the two components, the L/D ratio is preferably 2 or more. When the L/D ratio is less than 2 and excessively small, bonding the two components is destabilized, and fluctuation is produced during injection due to a melt viscosity difference between the polymers. As a result, the fiber size fluctuation value is hardly held in the range of the invention.

Although a larger L/D ratio is preferred, the ratio is preferably from 2 to 8 in view of the ease of preparing the nozzle, more preferably from 2.5 to 5.

The injection nozzle of the spinneret used in the present invention preferably has an inclination making an angle of from 10 to 40° with the vertical direction. The inclination angle of the injection nozzle with respect to the vertical direction designates an angle θ (degrees) in FIG. 3.

That the injection nozzle has an inclination making an angle with the vertical direction is an important requirement for solving the problem of filament bending caused by a melt viscosity difference during injecting two types of polyesters differing from each other in composition or intrinsic viscosity.

When the injection nozzle has no inclination, stabilized spinning becomes difficult due to, for example, a so-called bending phenomenon wherein use of a combination of two PTTs having a larger intrinsic viscosity difference between the two makes the filament immediately after injection bend toward the side of the polymer with a higher intrinsic viscosity.

In FIG. 3, the following procedure is preferred. A PTT having a higher viscosity is supplied to the A side, and another polyester or PTT is supplied to the B side, followed by injecting both polymers.

For example, when the PTTs differ from each other in intrinsic viscosity in an amount of about 0.1 or more, the injection nozzle preferably has an inclination that makes an angle of 10° or more with the vertical direction in order to solve the problem of bending and realize stabilized spinning. When the intrinsic viscosity difference is still larger, the inclination angle is preferably made larger. However, when the inclination angle becomes excessively large, exceeding 40°, the injection portion becomes elliptical, and stabilized spinning becomes difficult. Moreover, preparation of the nozzle itself becomes difficult. The inclination angle is preferably from 15 to 35°, more preferably from 20 to 30°.

In the present invention, the above inclination angle in combination with the ratio of an injection nozzle length to an injection nozzle diameter of 2 or more shows the effects more effectively. When the ratio is less than 2, the stabilized effects of injection are hardly obtained no matter how carefully the inclination angle is adjusted.

In the production method of the present invention, melt spinning is conducted using a spinneret having an injection nozzle as explained above, under the following condition: the product of an average intrinsic viscosity [θ] (dl/g) and an injection linear velocity V (m/min) of from 4 to 15 (dl/g)·(m/min), preferably from 5 to 10 (dl/g)·(m/min). The injection condition is important to solve the problem of contamination of an injection nozzle (contamination with polymer sticking to the periphery of the nozzle, so-called "eye mucus") caused by spinning over a long period of time, and makes a difference between stress values at 10% elongation fall in the range defined by the present invention.

When the product of an average intrinsic viscosity and an injection linear velocity is less than 4 (dl/g)·(m/min), contamination of the nozzle is decreased. However, the ratio of a winding rate to an injection rate becomes excessive, and the difference between stress values at 10% elongation exceeds 0.30 cN/dtex. Moreover, when the product exceeds 15 (dl/g)·(m/min), contamination of the nozzle increases, and continuous production of a conjugate fiber becomes difficult.

FIGS. 4 and 5 show a conjugate fiber spinning apparatus and a drawing machine, respectively, used in the production method of the invention.

First, PTT pellets that are one component, and that are dried with a drying machine 1 to have a moisture content of 20 ppm or less, are fed to an extruder 2 set at temperature of from 255 to 265° C., and melted. The other component is similarly dried with a drying machine 3, fed to an extruder 4, and melted.

The molten polymers are transferred to a spin head 7 set at temperature of from 250 to 265° C. through bends 5, 6, and separately metered with gear pumps. The two types of components are subsequently joined together in a spinneret 9 mounted on a spin pack 8 and having a plurality of nozzles, combined in a side-by-side manner, and extruded into a spinning chamber as multifilaments 10.

The multifilaments 10 of a polyester-based conjugate fiber extruded into the spinning chamber are cooled to room temperature with cooling air to be solidified. A finishing agent is applied to the solidified filaments with a finishing agent applicator 16, and the filaments are wound as an undrawn yarn package 15 of a polyester-based conjugate fiber having a given size with take-up godet rolls 13, 14 rotating at a predetermined rate.

In the present invention, the injected multifilaments are preferably passed through a non-air-blowing region provided directly below the spin head. The non-air-blowing region is preferably from 50 to 250 mm, more preferably from 100 to 200 mm. Provision of such a non-air-blowing region facilitate bonding of two types of polyesters differing from each other in intrinsic viscosity and, in particular, supresses pre-orientation of the component having a higher intrinsic viscosity, and a polyester-based conjugate fiber having high degree of crimp and high strength, and showing a low fiber size fluctuation value U%, is obtained.

In the production method of the invention, a finishing agent is applied to the cooled, solidified filaments. It is preferred that an aqueous emulsion type finishing agent or a neat finish be used as a finishing agent at a concentration of preferably 15% by weight or more, more preferably from 20 to 35% by weight.

The following (i) or (ii) is preferably used as a finishing agent:

(i) a finishing agent containing from 10 to 80% by weight of an aliphatic ester and/or a mineral oil; and (ii) a finishing agent containing from 50 to 98% by weight, preferably from 60 to 80% by weight of a polyether having a molecular weight of from 1,000 to 20,000, preferably from 2,000 to 10,000.

The amount of a finishing agent applied to the fiber is preferably from 0.3 to 1.5% by weight, more preferably from 0.5 to 1.0% by weight.

Application of such a finishing agent can make the dynamic friction coefficient between fibers from 0.2 to 0.35, and a polyester-based conjugate fiber pirn having a good winding angle in a taper portion and good surface recesses and protrusions in the cylinder portion can be obtained.

When the content of an aliphatic ester and/or a mineral oil in the finishing agent in (i) mentioned above is in the above range, the dynamic friction coefficient between fibers becomes 0.35 or less, and the surface recesses and protrusions in the cylinder portion of a pirn become good. Moreover, troubles such as injury of filaments cohesion during processing do not occur because static electricity is hardly generated on the fiber.

When the molecular weight of polyether in the finishing agent in (ii) described above is in the above range, the dynamic friction coefficient between fibers becomes 0.35 or less. Moreover, troubles such as separation and precipitation of polyether during processing do not occur. Furthermore, when the content of polyether is in the above range, the dynamic friction coefficient between fibers becomes 0.35 or less, and a polyester-based conjugate fiber pirn with a good shape can be obtained.

In the production of an undrawn yarn, the yarn is wound at a rate of preferably 3,000 m/min or less, more preferably from 1,000 to 2,000 m/min, and still more preferably from 1,200 to 1,800 m/min.

The undrawn yarn of a polyester-based conjugate fiber is then supplied to a drawing stage and is drawn with a drawing machine as shown in FIG. 5. The undrawn yarn thereof is stored preferably in the following environment before it is supplied to the drawing stage: atmospheric temperature of from 10 to 25° C.; and relative humidity of from 75 to 100%. Moreover, the undrawn yarn thereof on the drawing machine is preferably held in the above temperature and relative humidity through the period of drawing.

The undrawn yarn package 15 of a polyester-based conjugate fiber on the drawing machine is heated on a supply roll 17 set at temperature of from 45 to 65° C., and drawn to have a given size by utilizing the ratio of a peripheral velocity of a drawing roll 20 to a peripheral velocity of the supply roll 17. The polyester-based conjugate fiber is allowed to travel after or during drawing while being contacted with a hot plate 19 set at temperature of from 100 to 150° C. to be subjected to stretch heat treatment. The conjugate fiber coming from the drawing roll is wound while being twisted with a spindle to give a polyester-based conjugate fiber pirn 22.

The supply roll temperature is preferably from 50 to 60° C., more preferably from 52 to 58° C.

In the present invention, the conjugate fiber may optionally be drawn while a drawing pin 18 is being provided between the drawing roll 17 and the hot plate 19. In such a case, the drawing roll temperature should be strictly adjusted to a temperature preferably from 50 to 60° C., more preferably from 52 to 58° C.

The drawn yarn coming from a drawing roll 20 is wound while being made to form a balloon by a traveler guide 21 to give a polyester-based conjugate fiber pirn 22. The ballooning tension during winding is a centrifugal force caused by the spindle rotation, and is determined by the weight of the conjugate fiber and traveler guide and the rotation number of the spindle holding the conjugate fiber.

The winding angle of the polyester-based conjugate fiber pirn is set by adjusting a winding amount of the pirn and a winding width of a drawing machine traverse. Specifically, the winding width adjustment of the drawing machine traverse is conducted by means of "digital switch" built into a ring rail counter controller of the drawing machine.

In the production method of the present invention, it is preferred that the ratio of a speed of the drawing roll 20 to a speed of the supply roll 17 (namely, draw ratio) and the hot plate temperature be set in such a manner that the drawing tension becomes preferably from 0.10 to 0.35 cN/dtex, more preferably from 0.15 to 0.30 cN/dtex. When the drawing tension is in the above range, the winding hardness becomes 75 or more, and a stabilized winding shape is obtained. Moreover, the winding hardness becomes 92 or less, and a polyester-based conjugate fiber pirn showing good unwindability is obtained.

In the production method of the present invention, the relaxation ratio of a conjugate fiber from drawing with the drawing roll 17 to winding the fiber as a pirn is set at preferably from 2 to 5%, more preferably from 2 to 4%. When the relaxation ratio is in the above range, the winding hardness becomes from 75 to 92, and the pirn shape can be easily held. Because the relaxation ratio of a conventional PET fiber is 1% or less, the conjugate fiber pirn in the present invention is characterised in that it is prepared by winding while the conjugate fiber is being significantly relaxed.

In the production method of the present invention, the ballooning tension is preferably set at from 0.03 to 0.20 cN/dtex. Although a smaller ballooning tension is preferred, the balloon shape is sometimes disordered when the tension is excessively small. The ballooning tension is preferably from 0.05 to 0.15 cN/dtex. When the ballooning tension is in the above range, the winding density of the polyester-based conjugate fiber pirn becomes suitable, and the conjugate fiber in the pirn is sufficiently relaxed. As a result, the starting temperature of stress manifestation and the extreme temperature fall, in the ranges of the present invention, in the measurement of thermal shrinkage stress.

In the production method of the present invention, the polyester-based conjugate fiber pirn produced under the specific conditions as mentioned above is preferably aged in an atmosphere at temperature of from 25 to 45° C. for 10 days or more.

When the conjugate fiber wound in a pirn shape at a low winding density is held under such specific conditions, the starting temperature of dry heat shrinkage stress manifestation falls, in the range of the present invention, and the false twisting ability is improved.

When the holding temperature is much lower than 25° C., the relaxation becomes insufficient even if the aging period is further extended, or however low the winding density may be, and the object of the present invention is not achieved. When the holding temperature is much higher than 45° C., the relaxation becomes excessive, and drawbacks such as winding shape collapse take place. A preferred holding temperature is from 30 to 40° C., and a preferred holding period is 20 days or more.

Such aging conditions are satisfied in a natural environment even in a warehouse or the like during the summer. However, the polyester-based conjugate fiber pirn is preferably held in a thermo-hygrostat chamber for the purpose of avoiding the influence of seasonal variations.

In the production method of the present invention, the conjugate fiber is preferably subjected to interlacing and/or twisting at any stage until the fiber is wound in a pirn shape. In FIG. 3, for example, the conjugate fiber may be interlaced at any stage after application of a finishing agent and before winding the fiber into an undrawn yarn package. Moreover, in FIG. 5, for example, an interlacing applicator may be provided after the drawing roll 20. A known interlacer can be employed as the interlacing applicator.

In FIG. 5, for example, twisting can be imparted to the conjugate fiber by determining the ratio of a rotation number of the pirn to a surface speed of the drawing roll 20.

The number of interlacings and/or the number of twists is preferably from 2 to 50/m, more preferably from 6 to 30/m.

The polyester-based conjugate fiber pirn of the present invention is provided to false twisting stage. Commonly used false twisting methods such as pin type, friction type, nip belt type and air false twisting type methods may be employed. Although one heater false twisting or two heater false twisting may be employed, one heater false twisting is preferred in order to obtain good stretchability of the fabric.

The false twisting temperature is set so that the yarn temperature immediately after the outlet of the first heater becomes preferably from 130 to 200° C., more preferably from 150 to 180° C., and particularly preferably from 160 to 180° C.

The crimp ratio ($CE_{3.5}$) of a false-twisted yarn obtained by one heater false twisting is preferably from 15 to 70%, more preferably from 30 to 70%. The stretch elongation recovery is preferably 80% or more.

Furthermore, the conjugate fiber may also be heat set optionally with a second heater to give a two heater false-twisted yarn. The second heater temperature is preferably from 100 to 210° C., more preferably from −30° C. to +50° C. with respect to the yarn temperature immediately after the first heater outlet.

The overfeed ratio within the second heater (second overfeed ratio) is preferably from +3% to +30%.

In the present invention, the polyester-based false-twisted yarn obtained by false twisting a polyester-based conjugate fiber shows a stretch elongation, of crimp manifested before boiling water treatment, of from about 50 to 300%.

That the crimp manifested before boiling water treatment is significant is an important requirement for ensuring significant development of crimp and high elongation recovery subsequent to boiling water treatment of the fabric that shows a large constraint force, namely, excellent stretchability and instantaneous recovery.

The woven fabric for which the false-twisted yarn of a polyester-based conjugate fiber obtained in the present invention is used has stretchability even in the state of a gray fabric prior to boiling water treatment. Such properties have never been observed in known false-twisted yarns or known latent crimp conjugate fibers.

Furthermore, the false-twisted yarn of the polyester-based conjugate fiber shows, for example, a crimp ratio of 30% or more measured after boiling water treatment under a load of $3\times10^{-3}$ cN/dtex. That is, the false-twisted yarn characteristically shows development of a significant crimp. An ordinary false-twisted yarn obtained by false twisting a fiber formed from a PTT alone shows a crimp ratio of about 10% under the same conditions mentioned above. It is understood that the above false-twisted yarn shows extremely high crimpability when compared with the ordinary false-twisted yarn.

Still furthermore, the false-twisted yarn of the polyester-based conjugate fiber shows an elongation recovery speed of from 20 to 50 m/sec after boiling water treatment. Excellent instantaneous recovery is also a significant characteristic of the false-twisted yarn.

The elongation recovery speed signifies an instantaneous recovery speed of a fiber sample obtained by boiling water treating a false twisted yarn of a polyester-based conjugate fiber under no load, elongating the crimp to a given stress, and cutting the yarn. The measurement method is devised by the present inventors for the first time, and the stretching back properties can be measured quantitatively by the method.

Clothing prepared from the false-twisted yarn showing a large elongation recovery speed exhibits rapid stretch recovery, namely, excellent adaptability to body movement.

When a knitted fabric structure shows an elongation recovery speed of 15 m/sec or more, or a woven fabric structure shows an elongation recovery speed of 20 m/sec or more, it can be said that the knitted or woven fabric structure is excellent in adaptability to body movement. When the elongation recovery speed is much smaller than the above value, a fabric prepared therefrom tends to show insufficient adaptability to body movement. A preferred elongation recovery speed is 20 m/sec or more when the false-twisted yarn is used for a knitted fabric, and 25 m/sec or more when the false-twisted yarn is used for a woven fabric. On the other hand, a false-twisted yarn showing an elongation recovery speed of 50 m/sec or more is hardly produced according to the level of the present technologies.

According to the above measurement method, the elongation recovery speed of a known poly(ethylene terephthalate) false-twisted yarn is about 10 m/sec, and that of a false-twisted yarn of a fiber formed from PTT alone is about 15 m/sec. In view of a known spandex-based elastic fiber that shows an elongation recovery speed of from about 30 to 50 m/sec, it is understood that the false-twisted yarn of a polyester-based conjugate fiber obtained in the present invention exhibits an elongation recovery speed comparable to that of a spandex-based elastic fiber.

BRIEF DESCRIPTION OF THE DRAWINGS

In FIG. 1, the following are shown.

α—taper portions

β—cylinder portion

γ—winding angle in a taper portion

Figure 1:
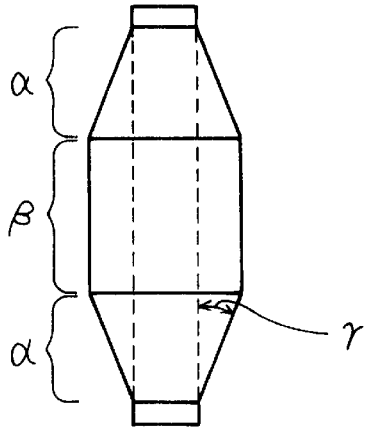
FIG. 1 is a schematic view showing one embodiment of a conjugate fiber pirn.
Figure 2:
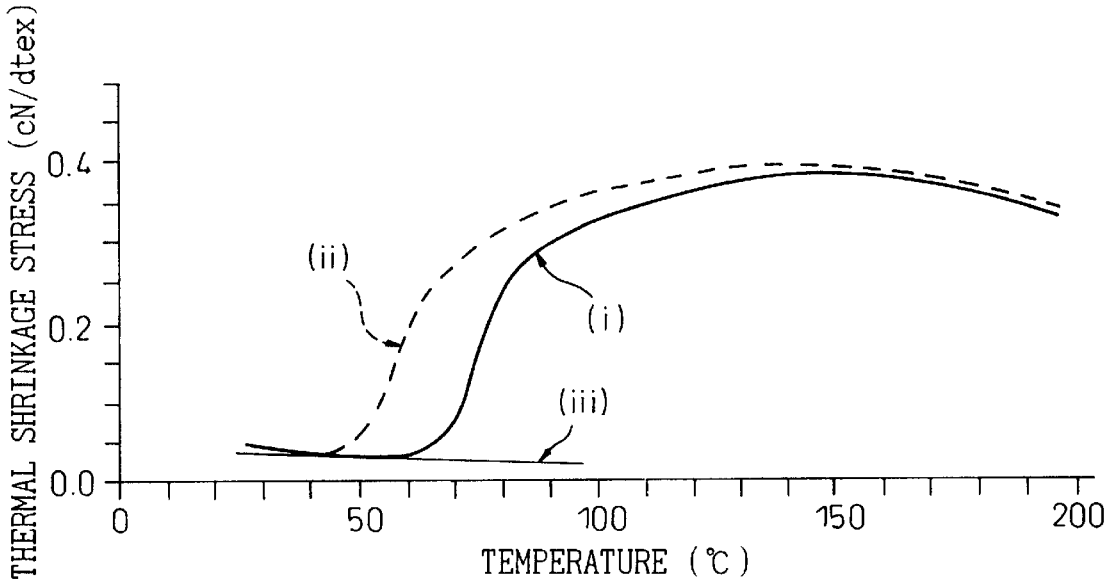

FIG. 2 is a graph showing one example of a thermal shrinkage stress curve. In FIG. 2, the following are shown.

(i)—curve (ii)—curve (iii)—baseline

Figure 3:
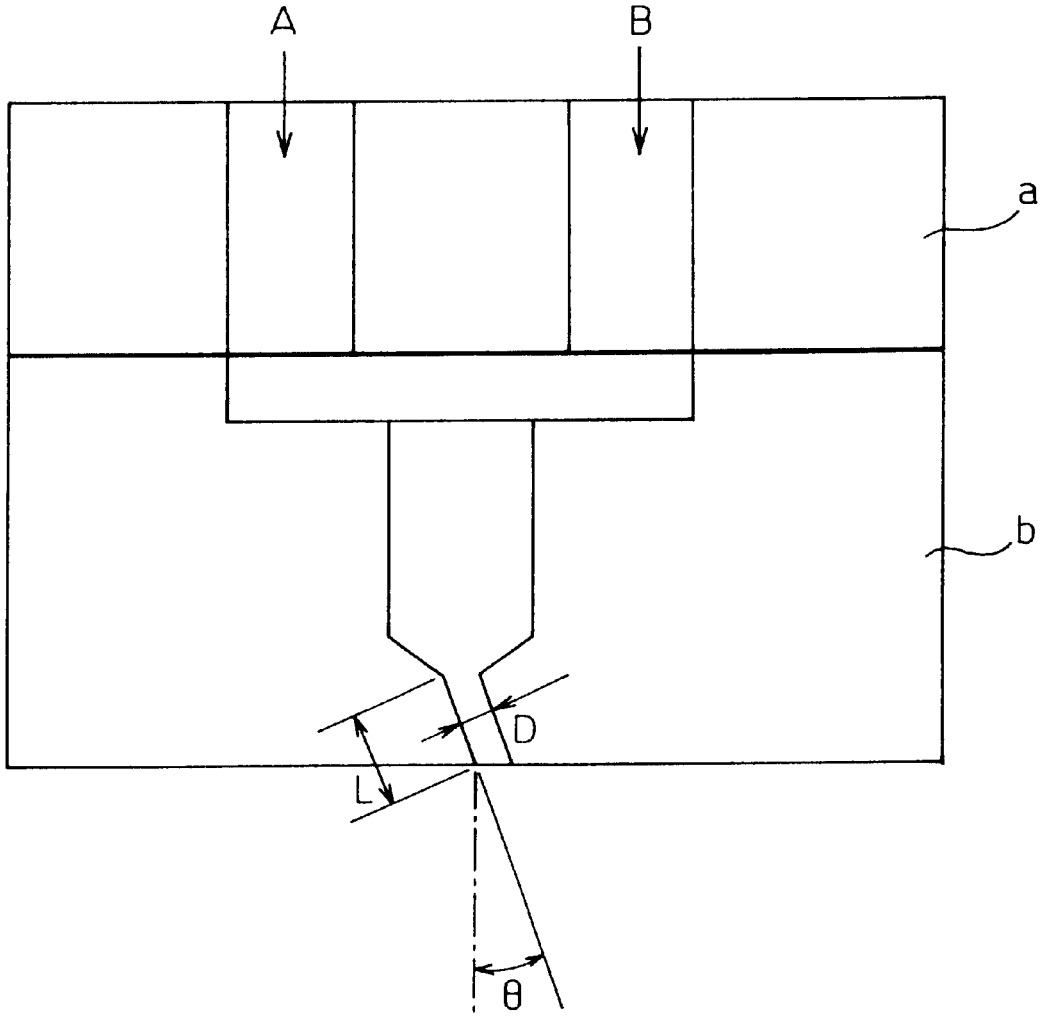

FIG. 3 shows one embodiment of an injection nozzle of a spinneret used in the production in the present invention. In FIG. 3, the following are shown.

a—distribution plate b—spinning nozzle

D—nozzle diameter

L—nozzle length

θ —inclination angle

Figure 4:
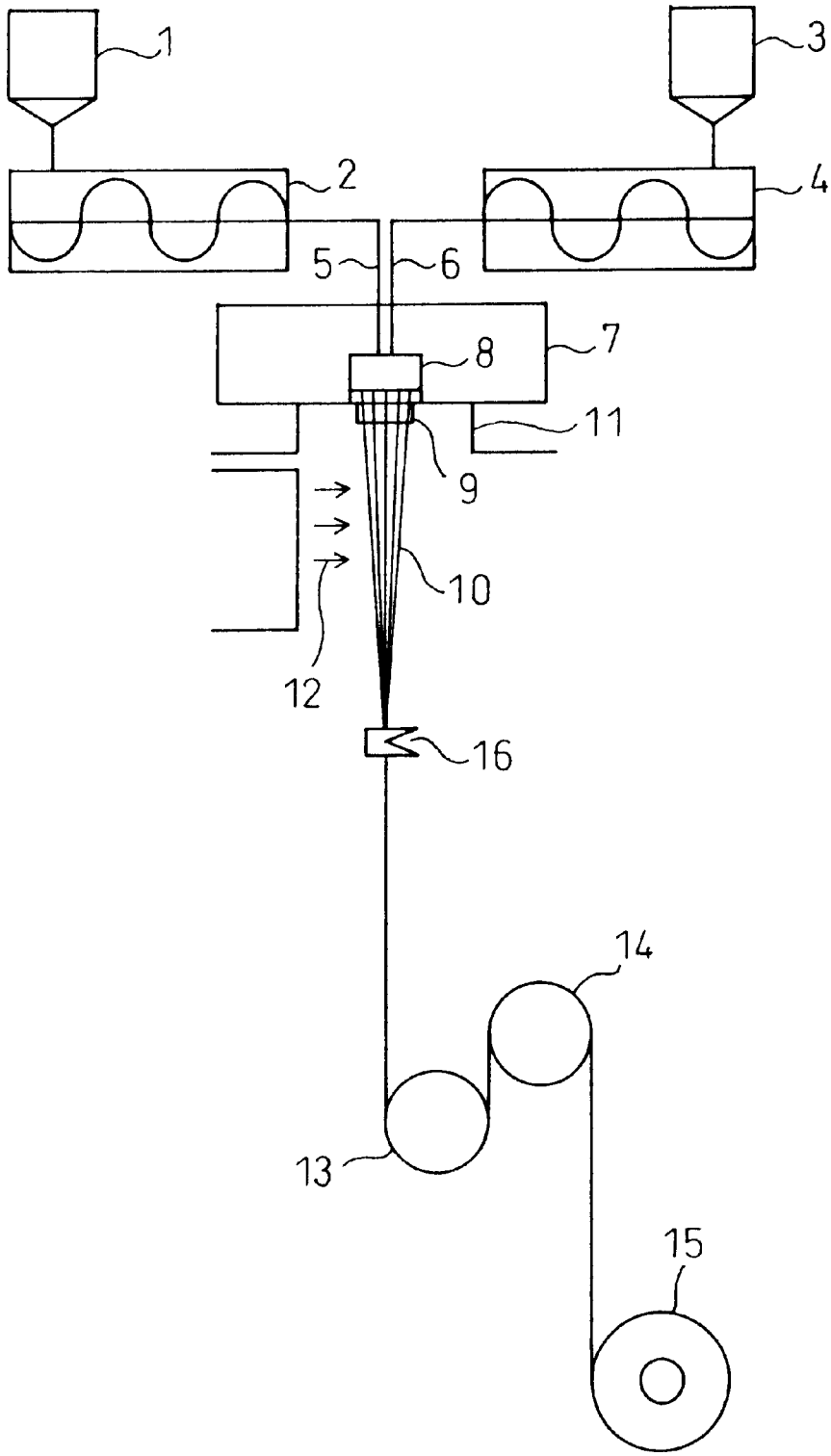

FIG. 4 is a schematic view showing one embodiment of a spinning apparatus used in the production in the present invention.

Figure 5:
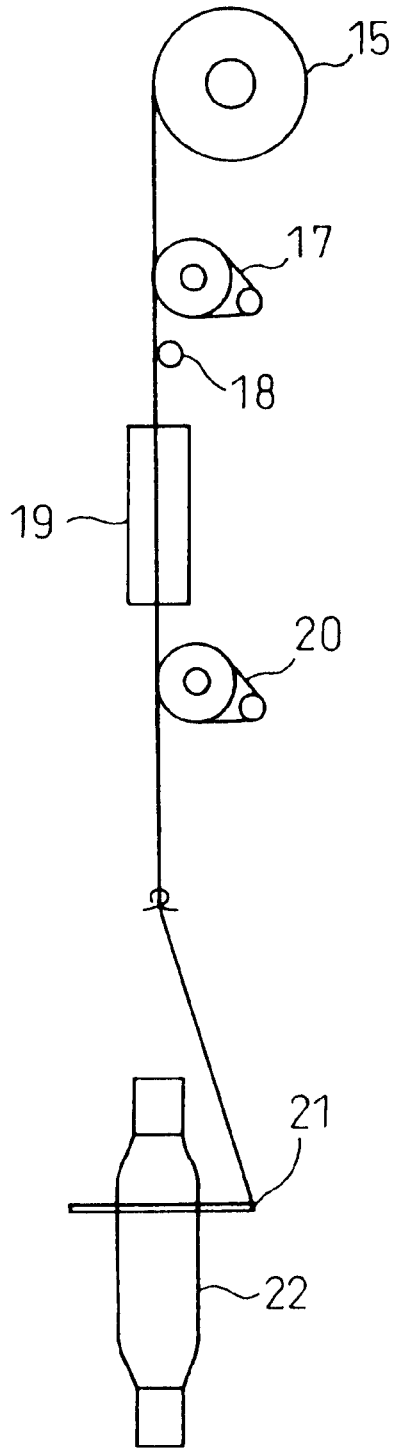

FIG. 5 is a schematic view showing one embodiment of a drawing machine used in the production in the present invention.

In addition, reference numerals in FIGS. 4, 5 designate components as follows.

1—polymer chip drying machine

2—extruder

3—polymer chip drying machine

4—extruder

5—bend

6—bend

7—spin head

8—spin pack

9—spinneret

10—multifilaments

11—non-air-blowing region

12—cooling air

13—take-up godet roll

14—take-up godet roll

15—undrawn yarn package

16—finishing agent applicator

17—supply roll

18—drawing pin

19—hot plate

20—drawing roll

21—traveler guide

22—drawn yarn pirn

BEST MODE FOR CARRYING OUT THE INVENTION

The present invention will be explained below in more detail by making reference to examples. However, it is needless to say that the present invention is not restricted thereto.

In addition, measurement methods, measurement conditions, and the like are as described below.

(1) Intrinsic Viscosity

The intrinsic viscosity [η] is a value determined on the basis of a definition of the following formula:

$$[\eta] = \lim_{C \to 0} (\eta_r - 1)/C$$

wherein $\eta_r$ is a value obtained by dividing a viscosity at 35° C. of a diluted solution of PTT dissolved in o-chlorophenol having a purity of 98% or more by the viscosity of the solvent measured at the same temperature, and C is a polymer concentration in terms of g/100 ml.

(2) Breaking Elongation

The breaking elongation is measured in accordance with JIS L 1013.

(3) Stress Value at 10% Elongation

The stress value at 10% elongation is measured in accordance with JIS L 1013.

The elongation-stress of a conjugate fiber is measured 100 times in the longitudinal direction of the yarn, and stresses at 10% elongation (cN) are measured. The maximum and minimum values of the measured values are read, and a value obtained by dividing the difference by the fiber size (dtex) is defined as the difference between stress values at 10% elongation (cN/dtex).

(4) Thermal Shrinkage Stress

Measurements are made with a thermal stress measurement apparatus (trade name of KE-2, manufactured by Kanebo Engineering K.K.). A conjugate fiber is cut to give a fiber sample 20 cm long. Both ends of the sample are tied to form a ring, which is mounted on the measurement apparatus. Measurements are made under the following conditions: an initial load of 0.044 cN/dtex; and a heating rate of 100° C./min. A chart of thermal shrinkage stress vs. temperature is drawn during the measurements.

The temperature at which the thermal shrinkage stress starts to appear, namely, the temperature at which the stress rises from the baseline, is defined as the starting temperature of thermal stress manifestation. The thermal shrinkage stress draws a mountain type curve in the high temperature region. The peak value is read as the extreme stress value (cN), which is halved and divided by the size (dtex). The initial load is subtracted from the resultant value to give a thermal shrinkage stress value.

Thermal shrinkage stress value (cN/dtex)={read value (cN)/2}/{fiber size (dtex)}−initial load (cN/dtex)

(5) Dynamic Friction Coefficient between Fibers

A fiber 690 m long is wound around a cylinder with a traverse angle of 15 degrees while a tension of about 15 g is being applied thereto. A fiber sample 30.5 cm long of the same fiber is placed on the cylinder so that the fiber sample is vertical to the cylinder axis. A weight with a load (g), of which numerical value is 0.04 times of numerical value of the total size of the fiber sample, placed on the fiber is tied to one end of the fiber sample, and a strain gauge is connected to the other end of the fiber sample.

Next, the cylinder is rotated at a peripheral speed of 18 m/min, and the tension is measured with a strain gauge. The dynamic friction coefficient between fibers is obtained from the tension thus measured, using the following formula:

$$f=(1/\pi)\times ln(T2/T1)$$

wherein T1 is a weight (g) tied to the fiber sample, T2 is an average tension (g) obtained by measuring at least 25 times, ln is natural logarithm, and π is the ratio of the circumference of a circle to its diameter. In addition, measurements are made at 25° C.

Measurements of a fluctuation in the longitudinal direction of the yarn are made in the following manner: measurements are made 10 times at about every 100 g of a fiber weight, and the difference between the maximum and minimum values is determined.

The average value of the values obtained by the above measurements is defined as the dynamic friction coefficient between fibers.

(6) Crimp Ratio ($CE_{3.5}$)

A yarn is hanked 10 times with a counter reel having a peripheral length of 1.125 m, and is treated in boiling water for 30 minutes while a load of $3.5\times10^{-3}$ cN/dtex is being applied. The yarn is then dry heat treated at 180° C. for 15 minutes under the same load, and then allowed to stand still over a whole night and day in a thermo-hygrostat chamber specified by JIS L 1013 while no load is being applied.

Next, the following loads are applied, and hank lengths are measured. The crimp ratio (%) is determined from the following formula:

$$\text{crimp ratio } (CE_{35})=\{(L2-L1)/L2\}\times100$$

wherein L1 is a hank length when a load of $1\times10^{-3}$ cN/dtex is applied, and L2 is a hank length when a load of 0.18 cN/dtex is applied.

The crimp ratio ($CE_{3.5}$) is measured 10 times every 100 g of a conjugate fiber in the longitudinal direction of the yarn, and the average value and the difference between the maximum and minimum values are determined.

(7) Winding Hardness of Pirn

The surface of the cylinder portion of a conjugate fiber pirn is quartered in the upper and lower direction, and also quartered at intervals of 90° in the circumferential direction. The hardness of the total 16 points is measured with a hardness meter (GC type A, manufactured by Tekurokku K.K.). The average value is defined as the winding hardness of the pirn.

(8) Level Difference between Surface Recesses and Protrusions

The level difference between surface recesses and protrusions of a drawn yarn pirn is measured by scanning the pirn cylinder portion from the top end to the bottom end with a three dimensional measurement apparatus (PA 800 A type, manufactured by Tokyo Seimitsu Co., Ltd.), and the maximum value (μm) of a difference between recessed portions and protruded portions is defined as the level difference between surface recesses and protrusions.

(9) Stretch Elongation and Stretch Modulus of False-Twisted Yarn

The stretch elongation and stretch modulus are measured in accordance with JIS L 1090 (Stretchability Test Method (A))

(10) Elongation Recovery Speed

A yarn is hanked 10 times with a counter reel having a peripheral length of 1.125 m, and treated in boiling water for 30 minutes without load. The yarn is then false twisted, and the following measurements are made in accordance with JIS L 1013.

The false-twisted yarn subsequent to boiling water treatment is allowed to stand over a whole day and night without load.

The false-twisted yarn is pulled until a stress of 0.15 cN/dtex is applied thereto using a tensile testing machine, and pulling is stopped. The yarn is held for 3 minutes, and a site immediately above the lower holding point is cut with scissors.

The shrinkage rate of the false-twisted yarn cut with scissors is determined by a method of picturing the shrinkage with a high-speed video camera (resolution of 1/1,000 sec). A ruler scaled at intervals of 1 mm is fixed in parallel with the false-twisted yarn. The camera is focused on the cut tip of the cut false-twisted yarn, and the recovery state of the cut tip is pictured. The videotaped recovery state is reproduced, and the displacement per unit time (mm/msec) of the cut tip of the false-twisted yarn is read, and the recovery rate is determined.

(11) Drawing Tension

The tension T1 (cN) applied to a fiber traveling in a space between a supply roll and a heat treatment apparatus (a space between the drawing pin 18 and the hot plate 19 in FIG. 5) during drawing is measured with a tensiometer (ROTHSCHILD Min TensR-046), and the drawing tension is obtained by dividing the measured value by a size D (dtex) of the yarn after drawing.

$$\text{Drawing tension } (cN/dtex)=T1/D$$

(12) Ballooning Tension

The tension T2 (cN) of a balloon formed between a drawing roll and a pirn (between the drawing roll 20 and the traveler guide 21 in FIG. 5) during rolling is measured in the same manner as in the measurement of a drawing tension, and the ballooning tension is obtained by dividing the measured value by a size D (dtex) of the yarn after drawing.

$$\text{Ballooning tension } (cN/dtex)=T2/D$$

(13) Unwindability, False Twisting Ability

False twisting is continuously conducted under the following conditions with 96 spindles/machine, and the unwindability and false twisting ability are evaluated from a number of yarn breakages per day.

False twisting machine: 33 H false twisting machine (belt type) manufactured by Murata Machinery Ltd.

False twisting conditions:

a yarn speed of 500 m/min;

a number of false twisting of 3,230 T/m;

a first feed ratio of −1%; and a first heater temperature of 170° C.

1) Unwindability

The unwindability is judged from a number of yarn breakage taking place from the drawn yarn pirn to the inlet of the feed roller according to the following criteria.

◎: The number of yarn breakage during unwinding is less than 10 times/day-machine, and the unwindability is very good.

○: The number of yarn breakage during unwinding is from 10 to 30 times/day-machine, and the unwindability is good.

X: The number of yarn breakage during unwinding exceeds 30 times/day-machine, and the industrial production is difficult.

2) False Twisting Ability

The false twisting ability is a number of yarn breakage on the heater after the feed roller, and is judged according to the following criteria.

◎: The number of yarn breakage is less than 10 times/day·machine, and the false twisting ability is very good.

○: The number of yarn breakage is from 10 to 30 times/day·machine, and the false twisting ability is good.

X: The number of yarn breakage exceeds 30 times/day·machine, and the industrial production is difficult.

(14) Dyeing Quality of False-Twisted Yarn

The dyeing quality of a false-twisted yarn is judged according to the following criteria by a skilled worker.

○: Very good

◎: Good x: Yarn having a dyeing line, not good

(15) Spinning Stability

Using a melt spinning machine on which a spinning nozzle having 4 ends per spindle is mounted, melt spinning is conducted for two days in each example, and then drawing is conducted.

The spinning stability is judged from a number of yarn breakage during the period, and a formation frequency (ratio of a number of fluff formation packages) of fluff present in the drawn yarn pirns thus obtained, according to the following criteria.

◎: No yarn breakage takes place, and the ratio of pirns having fluffs is 5% or less.

○: Yarn breakage takes place twice or less, and the ratio of pirns having fluffs is less than 10%.

X: Yarn breakage takes place three times or more, and the ratio of pirns having fluffs is 10% or more.

(16) Overall Evaluation

The unwindability and false twisting ability during false twisting and dyeing quality of the false-twisted yarn are all judged according to the following criteria.

◎: The unwindability, false twisting ability and dyeing quality are all very good.

○: The unwindability, false twisting ability or dyeing quality is good, and the remainder is very good.

X: The unwindability, false twisting ability or dyeing quality is not good.

EXAMPLES 1 to 5

Comparative Examples 1 to 2

In the present examples, the effects of the drawing tension and breaking elongation on the false twisting ability will be explained.

The spinning and drawing conditions in the present examples and comparative examples are as follows.

High viscosity component: PTT having an intrinsic viscosity of 1.3

Low viscosity component: PTT having an intrinsic viscosity of 0.9

The mixing ratio of a low viscosity component polymer to a high viscosity component polymer was 50:50 (wt. ratio). The conjugate fiber after drawing had a size of 84 dtex/24 f.

(Spinning Conditions)

Drying temperature of pellets and moisture content attained: 110° C., 15 ppm

Extruder temperature: 260° C. at A the axis, 260° C. at the B axis

Spin head temperature: 265° C.

Spinning nozzle diameter: 0.50 mm

Spinning nozzle length: 1.25 mm (L/D=2.5)

Inclination angle of spinning nozzle: 35°

Injection amount of polymer: determined under conditions so that the size of drawn yarn became 84 dtex $[\eta]\times V$: 5.5 to 6

Non-air-blowing region: 225 mm

Conditions of cooling air: temperature of 22° C., relative humidity of 90%, blowing speed of 0.5 m/sec Finishing agent: aqueous emulsion of a finishing agent (concentration of 30% by weight) composed of 55% by weight of an aliphatic ester, 10% by weight of a polyether, 30% by weight of a nonionic surfactant and 5% by weight of an antistatic agent Take-up rate: 1,500 m/min (Drawing Conditions)

Supply roll of drawing machine: 55° C.

Drawing pin: not used

Hot plate temperature: 130° C.

Drawing roll temperature: not heated (room temperature)

Draw ratio: determined so that the yarn had a drawing tension shown in Table 1

Relaxation ratio: 2.6%

Ballooning tension: 0.08 cN/dtex

Winding rate: 800 m/min

Winding amount: 2.5 kg/pirn (Physical Properties of Drawn Fiber)

Size: 83.2 dtex

Boil-off shrinkage: 13.1%

Adhesion ratio of finishing agent: 0.8% by weight

Number of interlacing: 8/m

Winding angle in taper portion of pirn: 19°

When a spun yarn was to be drawn, the draw ratio was varied so that the yarn had a drawing tension shown in Table 1.

The polyester-based conjugate fiber pirn thus obtained was aged for 30 days in a thermostatic chamber having a temperature of 35° C. and a relative humidity of 65%, and the conjugate fiber was false twisted. Table 1 shows the physical properties and false twisting ability of the polyester-based conjugate fiber pirn subsequent to aging.

It is evident from Table 1 that good unwindability and false twisting ability of a conjugate fiber pirn and good dyeing quality of a false-twisted yarn could be obtained as long as the drawing tension of the spun yarn was in the range of the present invention.

When the drawing tension was outside the range of the present invention and high, the unwindability and false twisting ability were not good. On the other hand, when the drawing tension was outside the range of the present invention and low, the breaking elongation of the conjugate fiber was large, and the false twisting ability was good. However, the dyeing quality of the false-twisted yarn was not good.

TABLE 1

| | C. E. 1 | Ex. 1 | Ex. 2 | Ex. 3 | Ex. 4 | Ex. 5 | C. E. 2 |
|---|---|---|---|---|---|---|---|
| Drawing tension (cN/dtex) | 0.40 | 0.29 | 0.26 | 0.20 | 0.18 | 0.10 | 0.04 |
| Winding hardness of pirn | 94 | 89 | 84 | 82 | 81 | 80 | 73 |
| Winding density of pirn (g/cm$^3$) | 1.11 | 1.00 | 0.98 | 0.97 | 0.96 | 0.95 | 0.89 |
| Level difference between surface recesses and protrusions in cylinder portion ($\mu$m) | 300 | 170 | 80 | 70 | 90 | 130 | 140 |
| Dynamic friction coefficient between fibers | 0.25 | 0.26 | 0.26 | 0.25 | 0.24 | 0.26 | 0.27 |
| Difference between maximum and minimum values of dynamic friction coefficient | 0.04 | 0.04 | 0.03 | 0.03 | 0.04 | 0.04 | 0.04 |
| Starting temperature of thermal stress manifestation (° C.) | 47 | 62 | 70 | 74 | 76 | 77 | 82 |
| Extreme temperature of thermal shrinkage stress (° C.) | 145 | 148 | 150 | 152 | 153 | 154 | 166 |
| Breaking elongation (%) | 26 | 32 | 35 | 40 | 43 | 50 | 70 |
| Difference between stress values at 10% elongation (cN/dtex) | 0.10 | 0.07 | 0.05 | 0.08 | 0.10 | 0.17 | 0.33 |
| Thermal shrinkage extreme stress (cN/dtex) | 0.35 | 0.27 | 0.24 | 0.22 | 0.20 | 0.10 | 0.04 |
| Crimp ratio ($CE_{3.5}$) (%) | 19 | 15 | 14 | 12 | 11 | 10 | 3 |
| Difference between maximum and minimum values of crimp ratio (%) | 4 | 4 | 3 | 3 | 3 | 3 | 4 |
| Unwindability | X | ○ | ◎ | ◎ | ◎ | ◎ | ○ |
| False twisting ability | X | ◎ | ◎ | ◎ | ◎ | ◎ | ○ |
| Dyeing quality of false twisted yarn | ○ | ○ | ◎ | ◎ | ◎ | ○ | X |
| Overall evaluation | X | ○ | ◎ | ◎ | ◎ | ○ | X |

EXAMPLES 6 to 9

Comparative Examples 3 to 4

In the present examples, the effects of the relaxation ratio during winding and the starting temperature of thermal shrinkage stress manifestation of a conjugate fiber on the false twisting ability will be explained.

The drawing conditions in the present examples and comparative examples are as follows.

(Drawing Conditions)

Supply roll of a drawing machine: 55° C.

Drawing pin: not used

Hot plate temperature: 130° C.

Drawing roll temperature: not heated (room temperature)

Drawing tension: 0.25 cN/dtex

Winding rate: 500 m/min

Winding amount: 2.5 kg/pirn (Physical Properties of Conjugate Fiber)

Size: 83.2 dtex

Breaking strength: 2.7 cN/dtex

Breaking elongation: 37%

Difference between stress values at 10% elongation: 0.05 cN/dtex

Boil-off shrinkage: 13.2%

Adhesion ratio of finishing agent: 0.7% by weight

Number of interlacings: 7/m

Winding angle in taper portion of pirn: 19°

When a conjugate fiber was to be wound, the ballooning tension was varied by changing a traveler guide and the number of rotations of a spindle so that the relaxation ratio was changed as shown in Table 2.

The polyester-based conjugate fiber pirn thus obtained was aged for 30 days in a thermostatic chamber having a temperature of 30° C. and a relative humidity of 65%.

Table 2 shows the unwindability and the false twisting ability of a conjugate fiber.

It is evident from Table 2 that good unwindability and a good false twisting ability could be achieved as long as the relaxation ratio was in the range of the present invention. Moreover, the dyeing quality of the false-twisted yarn thus obtained had no nonuniformity and was good. Furthermore, the crimp characteristics of the false-twisted yarn were also good.

When the relaxation ratio was outside the range of the present invention and large, winding collapse of the pirn took place during winding, and drawing had to be interrupted. On the other hand, when the relaxation ratio was small, the winding hardness was high, and yarn breakage during unwinding and false twisting often occurred.

The false-twisted yarn obtained by false twisting a conjugate fiber had excellent crimp characteristics shown below.

Size: 84.5 dtex

Breaking strength: 2.3 cN/dtex

Breaking elongation: 42%

Crimp ratio: ($CE_{3.5}$): 50%

Stretch modulus: 92%

Elongation recovery speed: 32 m/sec

TABLE 2

| | C. E. 3 | Ex. 6 | Ex. 7 | Ex. 8 | Ex. 9 | C. E. 4 |
|---|---|---|---|---|---|---|
| Relaxation ratio during winding (%) | 7 | 5 | 4 | 3 | 2 | 1 |
| Ballooning tension (cN/dtex) | 0.02 | 0.05 | 0.10 | 0.12 | 0.17 | 0.33 |
| Winding hardness of pirn | * | 80 | 82 | 83 | 85 | 94 |
| Winding density of pirn (g/cm$^3$) | * | 0.94 | 0.94 | 0.96 | 0.97 | 1.11 |
| Level difference between surface recesses and protrusions in cylinder portion ($\mu$m) | * | 90 | 70 | 70 | 100 | 280 |
| Starting temperature of thermal stress manifestation (° C.) | * | 73 | 70 | 65 | 62 | 45 |
| Extreme temperature of thermal shrinkage stress (° C.) | * | 154 | 152 | 150 | 145 | 140 |
| Thermal shrinkage extreme stress (cN/dtex) | * | 0.23 | 0.23 | 0.24 | 0.24 | 0.26 |
| Number of twisting (times/m) | * | 8 | 10 | 11 | 13 | 16 |
| Unwindability | * | ◎ | ◎ | ◎ | ◎ | X |
| False twisting ability | * | ◎ | ◎ | ◎ | ◎ | X |
| Dyeing quality of false-twisted yarn | * | ◎ | ◎ | ◎ | ◎ | ○ |
| Overall evaluation | X | ◎ | ◎ | ◎ | ◎ | X |

Note:
*Winding collapse made sampling impossible.

EXAMPLES 10 to 13

Comparative Examples 5 to 7

In the present examples, the effects of aging conditions of a conjugate fiber pirn on the false twisting ability will be explained.

A conjugate fiber spun under the same conditions as in Example 2 was held under conditions shown in Table 3 immediately after finishing drawing. The thermal shrinkage stress of the conjugate fiber was measured, and the fiber was false twisted.

It is evident from Table 3 that when the aging conditions were in the range of the present invention, good unwindability and false twisting ability could be obtained during false twisting.

EXAMPLES 14 to 15

Comparative Examples 8 to 9

In the present examples, the effects of the winding angle of a conjugate fiber pirn on the false twisting ability will be explained.

A conjugate fiber was spun in the same manner as in Example 2, and the winding angle of the conjugate fiber pirn was varied as shown in Table 4 by means of the digital switch built into the ring rail counter controller of the drawing machine during winding after drawing.

It is evident from Table 4 that, when the winding angle of a conjugate fiber pirn was in the range of the present invention, a good false twisting ability was achieved.

On the other hand, as shown in Comparative Examples 8 to 9, when the winding angle of a conjugate fiber pirn

TABLE 3

| | C. E. 5 | C. E. 6 | C. E. 7 | Ex. 10 | Ex. 11 | Ex. 12 | Ex. 13 |
|---|---|---|---|---|---|---|---|
| Aging temperature (° C.) | 15 | 15 | 15 | 30 | 35 | 35 | 40 |
| Aging days (day) | 1 | 10 | 20 | 20 | 10 | 20 | 10 |
| Winding hardness of pirn | 87 | 87 | 87 | 88 | 89 | 90 | 91 |
| Winding density of pirn (g/cm$^3$) | 0.93 | 0.94 | 0.95 | 0.96 | 0.97 | 0.97 | 0.98 |
| Level difference between surface recesses and protrusions in cylinder portion ($\mu$m) | 80 | 80 | 80 | 84 | 85 | 100 | 106 |
| Dynamic friction coefficient between fibers | 0.25 | 0.25 | 0.25 | 0.26 | 0.26 | 0.27 | 0.27 |
| Difference between maximum and minimum values of dynamic friction coefficient | 0.04 | 0.04 | 0.04 | 0.03 | 0.03 | 0.03 | 0.03 |
| Starting temperature of thermal stress manifestation (° C.) | 45 | 47 | 48 | 60 | 70 | 72 | 75 |
| Extreme temperature of thermal shrinkage stress (° C.) | 145 | 146 | 147 | 152 | 158 | 160 | 165 |
| Thermal shrinkage extreme stress (cN/dtex) | 0.24 | 0.24 | 0.24 | 0.23 | 0.22 | 0.21 | 0.20 |
| Difference between stress values at 10% elongation (cN/dtex) | 0.07 | 0.07 | 0.06 | 0.05 | 0.04 | 0.04 | 0.05 |
| Unwindability | X | ○ | ○ | ◎ | ◎ | ◎ | ○ |
| False twisting ability | X | X | X | ◎ | ◎ | ◎ | ◎ |
| Dyeing quality of false-twisted yarn | ○ | ○ | ○ | ◎ | ◎ | ◎ | ◎ |
| Overall evaluation | X | X | X | ◎ | ◎ | ◎ | ○ |

exceeded the range of the present invention, winding collapse often took place, and high-speed false twisting was difficult.

TABLE 4

| | Ex. 14 | Ex. 15 | C. Ex. 8 | C. Ex. 9 |
|---|---|---|---|---|
| Winding angle in taper portion (degrees) | 18 | 21 | 23 | 25 |
| Winding hardness of pirn | 83 | 83 | 84 | * |
| Winding density of pirn ($g/cm^3$) | 0.95 | 0.95 | 0.96 | * |
| Unwindability | ◎ | ◎ | X | * |
| False twisting ability | ◎ | ◎ | X | * |
| Dyeing quality of false-twisted yarn | ◎ | ◎ | ○ | * |
| Overall Evaluation | ◎ | ◎ | X | X |

Note:
*Winding shape collapsed during drawing, and drawing became impossible.

component, and a PBT having an intrinsic viscosity of 0.9 was used as a low viscosity component. In Example 18, a PTT having an intrinsic viscosity of 1.3 was used as a high viscosity component, and a PET having an intrinsic viscosity of 0.51 was used as a low viscosity component. In Comparative Example 10, a PET having an intrinsic viscosity of 0.72 and a PET having an intrinsic viscosity of 0.5 were used.

Table 5 shows the physical properties of the conjugate fibers thus obtained and the quality of the false-twisted yarns thus obtained.

Although the conjugate fiber pirn obtained in Comparative Example 10 showed good unwindability and good false twisting ability, the false-twisted yarn showed, under load, a stretch elongation of 30% or less and an elongation recovery speed as low as 12 m/sec.

TABLE 5

| | Ex. 16 | Ex. 17 | Ex. 18 | C. E. 10 |
|---|---|---|---|---|
| Polymer composition | PTT/cpd. PTT | PTT/PBT | PTT/PET | PET/PET |
| Winding hardness of pirn | 83 | 82 | 84 | 93 |
| Winding density of pirm ($g/cm^3$) | 0.96 | 0.96 | 1.05 | 1.12 |
| Level difference between surface recesses and protrusions in cylinder portion ($\mu m$) | 90 | 90 | 90 | 80 |
| Dynamic friction coefficient between fibers | 0.27 | 0.28 | 0.27 | 0.35 |
| Difference between maximum and minimum values of dynamic friction coefficient | 0.03 | 0.04 | 0.04 | 0.04 |
| Starting temperature of thermal stress manifestation (° C.) | 67 | 65 | 65 | 48 |
| Extreme temperature of thermal shrinkage stress (° C.) | 151 | 146 | 145 | 166 |
| Thermal shrinkage extreme stress (cN/dtex) | 0.24 | 0.24 | 0.30 | 0.37 |
| Breaking elongation (%) | 36 | 37 | 37 | 27 |
| Difference between stress values at 10% elongation | 0.12 | 0.08 | 0.16 | 0.23 |
| Crimp ratio ($CE_{3\ 5}$) (%) | 14 | 13 | 11 | 2 |
| Difference between maximum and minimum values of crimp ratio (%) | 3 | 3 | 4 | 2 |
| Unwindability | ◎ | ◎ | ◎ | ○ |
| False twisting ability | ◎ | ◎ | ◎ | ○ |
| Dyeing quality of false-twisted yarn | ◎ | ◎ | ◎ | ◎ |
| Crimp ratio of false-twisted yarn ($CE_{3\ 5}$) (%) | 52 | 48 | 15 | 5 |
| Elongation recovery speed of false-twisted yarn (m/sec) | 26 | 22 | 20 | 12 |
| Overall evaluation | ◎ | ◎ | ◎ | X |

EXAMPLES 16 to 18

Comparative Example 10

In the present examples, cases where the components of each fiber differed among fibers will be explained.

Conjugate fibers were obtained in the same manner as in Example 2.

In Example 16, a PTT having an intrinsic viscosity of 1.3 was used as a high viscosity component, and a PTT prepared by copolymerizing 2% by mole of 5-sodium sulfoisophthalic acid and having an intrinsic viscosity of 0.7 was used as a low viscosity component. In Example 17, a PTT having an intrinsic viscosity of 1.3 was used as a high viscosity

EXAMPLES 19 to 22

Comparative Example 11 to 13

In the present examples, in spinning a conjugate fiber, the effects of the injection conditions of an injection nozzle after joining the two types of polyester components will be explained.

In the spinning in Example 2, the following factors were varied as shown in Table 6, and melt spinning was conducted: the ratio of a nozzle length to a nozzle diameter (L/D); an inclination angle made by an inclination of an injection nozzle with the vertical direction; and a product of an average intrinsic viscosity [η] (dl/g) and an injection linear velocity V (m/min).

Table 6 shows the spinnability, the false twisting ability of a conjugate fiber pirn, and the dyeing quality of a false-twisted yarn.

It is evident from Table 6 that, when the factors were in the above ranges of the invention, good spinnability, good false twisting ability and good dyeing quality of a false-twisted yarn were obtained.

TABLE 6

| | C. E. 11 | Ex. 19 | Ex. 20 | Ex. 21 | C. E. 12 | Ex. 22 | C. E. 13 |
|---|---|---|---|---|---|---|---|
| Injection nozzle diameter (mm) | 0.3 | 0.4 | 0.5 | 0.5 | 0.5 | 0.6 | 0.7 |
| Inclination angle of injection nozzle (degrees) | 30 | 30 | 40 | 30 | 0 | 20 | 30 |
| L/D | 2.5 | 2.5 | 2.5 | 2.5 | 2.5 | 4.0 | 1.0 |
| Average intrinsic viscosity [η] (dug) | 0.95 | 0.95 | 0.95 | 0.95 | 0.95 | 0.95 | 0.95 |
| [η] × V (dl/g · m/min) | 16.0 | 9.0 | 5.8 | 5.8 | 5.8 | 4.0 | 2.9 |
| Spinnability | X | ◎ | ◎ | ◎ | X | ○ | X |
| Difference between stress values at 10% elongation (cN/dtex) | 0.32 | 0.07 | 0.10 | 0.10 | * | 0.23 | 0.35 |
| Unwindability | ○ | ◎ | ◎ | ◎ | * | ○ | ○ |
| False twisting ability | ◎ | ◎ | ◎ | ◎ | * | ◎ | ○ |
| Dyeing quality of false-twisted yarn | X | ◎ | ◎ | ◎ | * | ○ | X |
| Overall evaluation | X | ◎ | ◎ | ◎ | X | ○ | X |

Note:
*Yarn bending made sampling impossible.

Industrial Applicability

The present invention provides a polyester-based conjugate fiber pirn suitable for clothing, and a method for producing the same. The polyester-based conjugate fiber pirn of the present invention is excellent in false twisting ability, and can be provided with false twisting at a high rate. Moreover, the false-twisted yarn thus obtained has good crimp characteristics and dyeing quality as well as properties appropriate to woven or knitted fabric applications.

The production method of the present invention is a method for producing, by two stages, a conjugate fiber at least one polyester component of which is formed from PTT. That is, the production method is a method for producing a polyester-based conjugate fiber pirn, comprising a winding stage of an undrawn conjugate fiber formed from a spun yarn, and a subsequent drawing stage. A polyester-based conjugate fiber pirn excellent in false twisting ability can be obtained by setting a drawing tension during drawing, a relaxation ratio during winding a conjugate fiber in a pirn shape, and the like at specific ranges, and aging the conjugate fiber pirn under specific conditions.

What is claimed is:

1. A polyester-based conjugate fiber pirn characterized in that the polyester-based conjugate fiber pirn is formed by winding in a pirn shape that satisfies the conditions (1) to (4) mentioned below, a conjugate fiber wherein the fiber is formed from a single filament prepared by combining two types of polyester components in a side-by-side manner or in an eccentric sheath-core manner, and at least one polyester component forming the single filament is poly (trimethylene terephthalate) containing 90% by mole or more of trimethylene terephthalate repeating units:

(1) the winding amount of the conjugate fiber pirn 1 kg or more;

(2) the winding angle in a taper portion thereof is from 15 to 21;

(3) the winding hardness in the cylinder portion the eof is from 75 to 92; and (4) the starting temperature of thermal shrinkage stress manifestation of the conjugate fiber is from 50 to 80° C.

2. The polyester-based conjugate fiber pirn according to claim 1 wherein the pirn satisfies the conditions mentioned b low:

(3) the winding hardness in the cylinder portion the eof is from 80 to 90;

(4) the starting temperature of thermal shrinkage stress manifestation of the conjugate fiber is from 50 to 75° C.;

(5) the level difference between surface recesses and surface protrusions in the cylinder portion thereof is 250 μm or less; and (6) the dynamic friction coefficient between fibers the conjugate fiber is form 0.20 to 0.35.

3. The polyester-based conjugate fiber pirn according to claim 1 or 2, wherein the difference between the maximum a d minimum values of a dynamic friction coefficient between fibers of the conjugate fiber in the longitudinal direction of the yarn is 0.05 or less.

4. The polyester-based conjugate fiber pirn according to claim 1 or 2, wherein winding density of the pirn is from 0.90 to 1.10 g/cm$^3$.

5. The polyester-based conjugate fiber pirn according to claim 1 or 2, wherein the difference between the maximum and minimum values of a stress at 10% elongation is 0.30 cN/dtex or less in elongation-stress measurements of the conjugate fiber.

6. The polyester-based conjugate fiber pirn according to claim 1 or 2, wherein the breaking elongation of the conjugate fiber is from 30 to 50%.

7. The polyester-based conjugate fiber pirn according to claim 1 or 2, wherein the difference between the maximum and minimum values of a crimp ratio ($CE_{3.5}$) of the conjugate fiber measured while a load of $0.5\times10^{-3}$ cN/dtex is being applied to the fiber is 10% or less.

8. The polyester-based conjugate fiber pirn according to claim 1 or 2, wherein the shape-modification degree of the conjugate fiber is from 1 to 5.

9. The polyester-based conjugate fiber pirn according to claim 1 or 2, wherein both of the two types of components of a sing e filament forming the conjugate fiber are poly (trimethylene terephthalate) containing 90% by mole or more of trimethylene terephthalate repeating units, and the thermal shrinkage stress of the conjugate fiber is from 0.1 to 0.24 cN/dtex.

10. A false-twisted yarn obtained by t e false twisting the polyester-based conjugate fiber wound in the shape of the polyester-based conjugate fiber pirn according to claim 1 or 2.

11. A method for producing a polyester-based conjugate fiber pirn, wherein two types of polyesters in which at least one type of polyester contains 90% by mole or more of trimethylene terephthalate repeating units are injected from a spinneret by melt spinning, the injected polyesters are cooled and solidified with cooling air, the solidified yarn is drawn, and a conjugate fiber formed from a single filament that is formed by combining the two types of polyesters in a side-by-side manner or in an eccentric sheath-core manner is wound in a pirn shape in an amount of 1 kg or more, the method satisfying the conditions (A) to (C) mentioned below:

(A) the tension of the yarn during drawing is from 0.10 to 0.35 cN/dtex;

(B) the relaxation ratio during winding the conjugate fiber in a pirn shape is from 2 to 5%; and (C) the conjugate fiber pirn is aged in an atmosphere at a temperature of from 25 to 45° C. for 10 days or more.

12. The method for producing a polyester-based conjugate fiber pirn according to claim 11, wherein the method satisfies the conditions mentioned below:

(a) the two types of polyesters are joined together i a spinneret, and injected through an injection nozzle that has a ratio of a nozzle length to a nozzle diameter or 2 or more and that has an inclination making an angle of from 10 to 40° with the vertical direction; and (b) the two types of polyesters are melt spun to for an undrawn yarn while the product of an average intrinsic viscosity [η] (dl/g) and an injection linear velocity V (m/mm) thereof is being held at 4 to 15 (dl/g)·(m/min).

13. The method for producing a polyester-based conjugate fiber pirn according to claim 11 or 12, wherein the yarn is interlace and/or twisted at any stage between the following stages: a stage of applying a finishing agent containing from 10 to 80% by weight of aliphatic ester and/or mineral oil or a finishing agent containing from 50 to 98% by weight of a polyether having a molecular weight of from 1,000 to 20,000 in an amount of from 0.3 to 1.5% by weight after cooling and solidifying the injected polyester to form a fiber; and a stage of winding the fiber in a pirn shape.

14. The method for producing a polyester-based conjugate fiber pirn according to claim 11 or 12 wherein the conjugate fiber pirn is aged in an atmosphere at a temperature of from 30 to 40°.

* * * * *

UNITED STATES PATENT AND TRADEMARK OFFICE

CERTIFICATE OF CORRECTION

PATENT NO. : 6,673,443 B2
DATED : January 6, 2004
INVENTOR(S) : Tadashi Koyanagi et al.

It is certified that error appears in the above-identified patent and that said Letters Patent is hereby corrected as shown below:

Column 27,
Line 48, “winding in” should read -- winding, in --.
Line 57, “pirn 1” should read -- pirn is 1 --.
Line 60, “to 21;” should read -- to 21°; --.
Line 61, “the eof” should read -- thereof --.
Line 67, “b low” should read -- below --.

Column 28,
Line 1, “the eof” should read -- thereof --.
Line 28, “fibers the” should read -- fibers of the --.
Line 29, “form” should read -- from --.
Line 50, “$0.5x10^{-3}$” should read -- $3.5x10^{-3}$ --
Line 57, “sing e” should read -- single --.
Line 62, “t e” should read -- the --.

Column 29,
Line 20, “i a” should read -- in a --.
Line 22, “or 2” should read -- of 2 --.

Column 30,
Line 3, “for” should read -- form --.
Line 6, “(m/mm)” should read -- (m/min) --.
Line 9, “interlace” should read -- interlaced --.
Line 20, “to 40°.” should read -- to 40°C. --.

Signed and Sealed this

Thirtieth Day of November, 2004

JON W. DUDAS
*Director of the United States Patent and Trademark Office*